US007143825B2

(12) United States Patent
Pointing

(10) Patent No.: US 7,143,825 B2
(45) **Date of Patent: *Dec. 5, 2006**

(54) EXPANDABLE WELLBORE STABILISER

(75) Inventor: Michael Edward Pointing, Rijswijk (NL)

(73) Assignee: Shell Oil Company, Houston, TX (US)

( * ) Notice: Subject to any disclaimer, the term of this patent is extended or adjusted under 35 U.S.C. 154(b) by 198 days.

This patent is subject to a terminal disclaimer.

(21) Appl. No.: 10/483,278

(22) PCT Filed: Jul. 10, 2002

(86) PCT No.: PCT/EP02/07883

§ 371 (c)(1),
(2), (4) Date: Jan. 9, 2004

(87) PCT Pub. No.: WO03/006789

PCT Pub. Date: Jan. 23, 2003

(65) Prior Publication Data

US 2004/0173349 A1 Sep. 9, 2004

(51) Int. Cl.
*E21B 17/10* (2006.01)

(52) U.S. Cl. ..... 166/241.6; 166/207; 175/325.5

(58) Field of Classification Search ..... 166/380, 166/384, 207, 241.1, 241.6; 175/325.5
See application file for complete search history.

(56) References Cited

U.S. PATENT DOCUMENTS 1,997,880 A 4/1935 Watry ..... 255/28
2,035,637 A 3/1936 Crickmer ..... 308/4
2004/0182571 A1* 9/2004 Betts ..... 166/241.6

FOREIGN PATENT DOCUMENTS

WO 99/18328 4/1999

OTHER PUBLICATIONS

International Search Report dated Oct. 23, 2002.

* cited by examiner

*Primary Examiner*—David Bagnell
*Assistant Examiner*—Nicole A. Coy
(74) *Attorney, Agent, or Firm*—Rachael Stiegel

(57) ABSTRACT

A stabiliser is disclosed for stabilising a radially expandable tubular element extending in a wellbore drilled into an earth formation. The stabiliser comprises a radially expandable tubular member selected from a section of the tubular element and a sleeve surrounding the tubular element, and at least one stabiliser arm connected to the tubular member, each arm being movable from a radially retracted position to a radially extended position by the action of a spring force. The stabiliser further comprises locking means arranged to lock each arm in the retracted position when the tubular element is in the unexpanded form and to unlock the arm upon radial expansion of the tubular member so as to allow the arm to move to the extended position thereof.

11 Claims, 2 Drawing Sheets

EXPANDABLE WELLBORE STABILISER

FIELD OF THE INVENTION

The present invention relates to a stabiliser for stabilising a tubular element extending in a wellbore drilled into an earth formation. The tubular element is, for example, a casing, which is to be cemented in the wellbore. Generally it is desirable that the casing is positioned centrally in the wellbore before and during cementing in order to ensure that the annular cement layer between the casing and the wellbore wall provides sufficient isolation both in radial and longitudinal direction. In the specification hereinafter the terms "stabiliser" and "centraliser" are used, both referring to the same meaning.

BACKGROUND OF THE INVENTION

Various types of centralisers have been applied to stabilise and centralise a tubular element, such as a casing, in a wellbore. One such centraliser is a bow centraliser, which is provided with spring-type arms extending against the wellbore wall. However, such known centralisers are less applicable for tubulars which are to be radially expanded in the wellbore.

SUMMARY OF THE INVENTION

In accordance with the invention there is provided a stabiliser for a radially expandable tubular element extending in a wellbore drilled into an earth formation, the stabiliser comprising a radially expandable tubular member selected from a section of the tubular element and a sleeve surrounding the tubular element, and at least one stabiliser arm connected to the tubular member, each arm being movable from a radially retracted position to a radially extended position by the action of a spring force, the stabiliser further comprising locking means arranged to lock the arm in the retracted position when the tubular element is in the unexpanded form and to unlock the arm upon radial expansion of the tubular member so as to allow the arm to move to the extended position thereof.

It is thereby achieved that, upon radial expansion of the tubular member in the wellbore, the tubular member stretches in circumferential direction so that the locking means becomes unlocked and each arm is moved by the spring force to its radially extended position. The arms thereby become biased against the wellbore wall and stabilise/centralise the tubular element in the wellbore.

Suitably each arm is integrally connected to the tubular member, and the spring force stems from elastic deformation of the arm relative to the member element when the arm is in its retracted position.

To enable easy installation of the tubular element in the wellbore, it is preferred that the arm, when in the retracted position thereof, extends in substantially circumferential direction of the tubular member.

Preferably the stabiliser comprises a plurality of said arms including at least two said arms located at substantially the same circumferential position and at selected mutual axial spacing.

To achieve adequate centralising of the tubular element in the wellbore, suitably the stabiliser comprises a plurality of said arms including at least three arms at selected mutual circumferential spacing.

BRIEF DESCRIPTION OF THE DRAWINGS

The invention will be described hereinafter in more detail and by way of example with reference to the accompanying drawings in which.

DETAILED DESCRIPTION OF THE INVENTION

Figure 1:
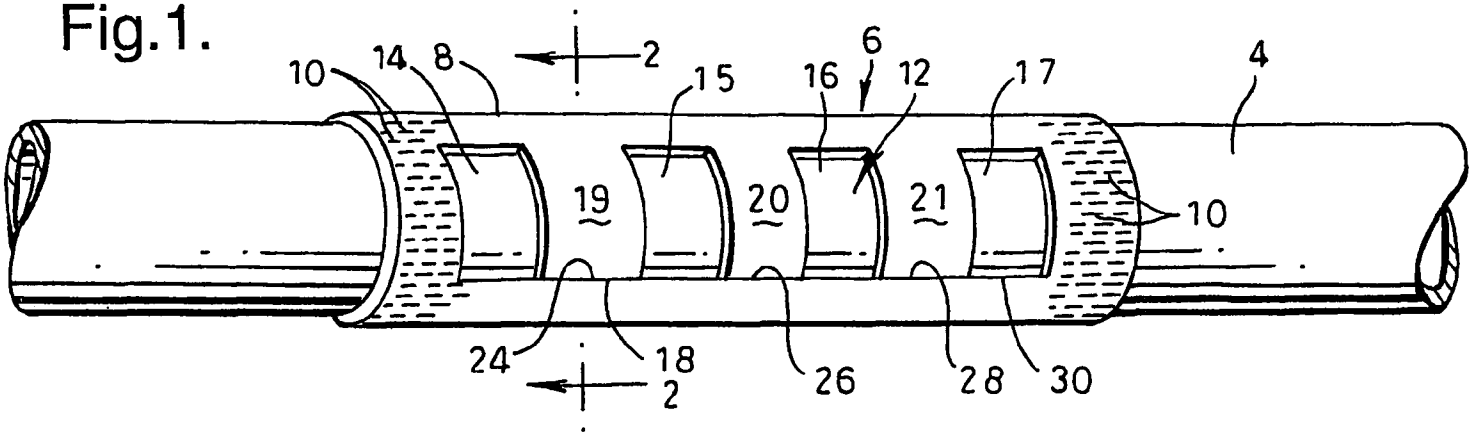
FIG. 1 schematically is a perspective view of an expandable tubular element provided with an embodiment of a stabiliser according to the invention.
Figure 2:
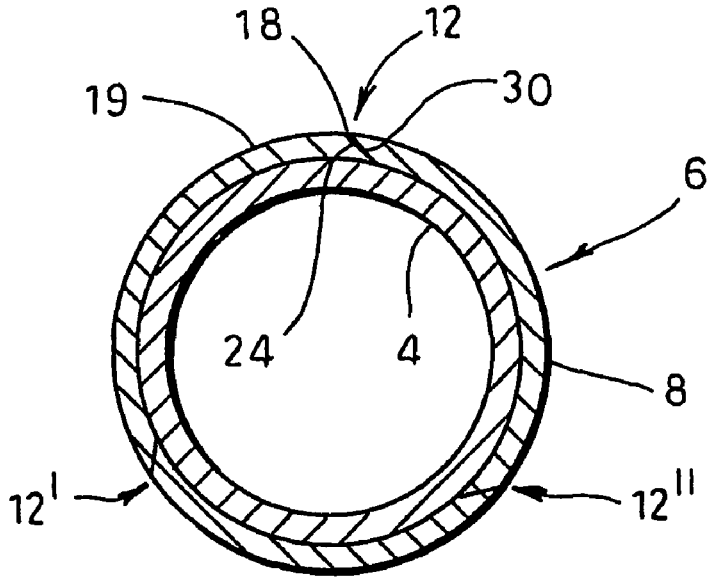
FIG. 2 schematically shows cross-section 2—2 of FIG. 1.

Referring to FIGS. 1 and 2 there is shown a tubular element in the form of a casing 4, prior to radial expansion thereof, of a wellbore (not shown) formed in an earth formation. The casing 4 is provided with a stabiliser 6 for stabilising and/or centralising the casing 4 in the wellbore. The stabiliser 6 includes a radially expandable tubular member in the form of a sleeve 8 surrounding the casing 2. The sleeve 8 is provided with longitudinal slots 10 (only some of the slots are shown for ease of reference) which are overlapping in longitudinal direction so that only a low expansion force is required to radially expand the sleeve 8. Furthermore, the sleeve 8 is provided with three cut-out portions 12, 12', 12" regularly spaced along the circumference of the sleeve 8, whereby in FIG. 1 only one cut-portion 12 is shown for ease of reference. The two other cut-out portions 12', 12" are similar in shape and size to cut-out portion 12.

Cut-out portion 12 is formed of four rectangular cut-out sections 14, 15, 16, 17 which are interconnected by a longitudinal cut 18. The cut-out sections 14, 15, 16, 17 and longitudinal cut 18 define three rectangular arms 19, 20, 21 integrally connected to the remaining part of sleeve 8.

The longitudinal cut 18 extends inclined relative to the circumferential direction of the sleeve 8 thereby defining inclined circumferential end surfaces 24, 26, 28 of the respective arms 19, 20, 21 and complementary inclined circumferential end surface 30 of the remaining part of sleeve 8.

As shown in FIG. 2, the inclined end surfaces 24, 26, 28 of the arms 19, 20, 21 are locked behind the inclined end surface 30 of the remaining part of the sleeve 8, thereby retaining the arms 19, 20, 21 in a radially retracted position. Each arm 19, 20, 21 has been plastically deformed in a manner that the arm assumes a radially extended position (as shown in FIG. 3) when no longer radially retracted, and that the arm is subject to elastic deformation when radially retracted (as shown in FIG. 2).

Figure 3:
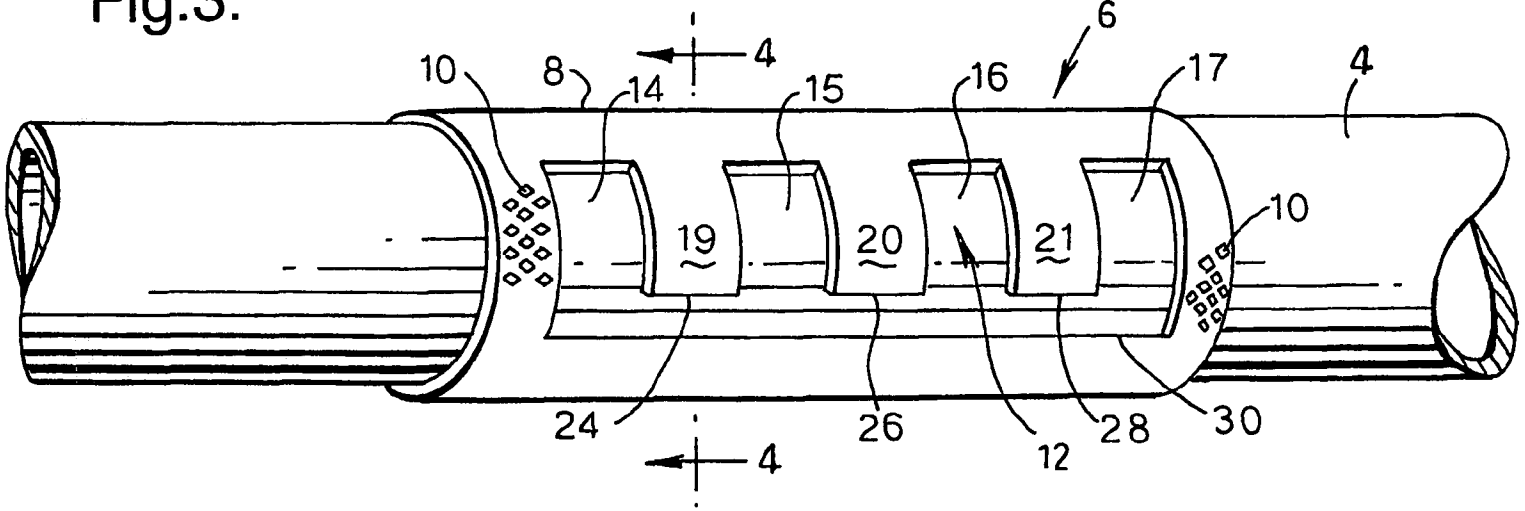
FIG. 3 schematically shows the tubular element of FIG. 1 after radial expansion thereof.
Figure 4:
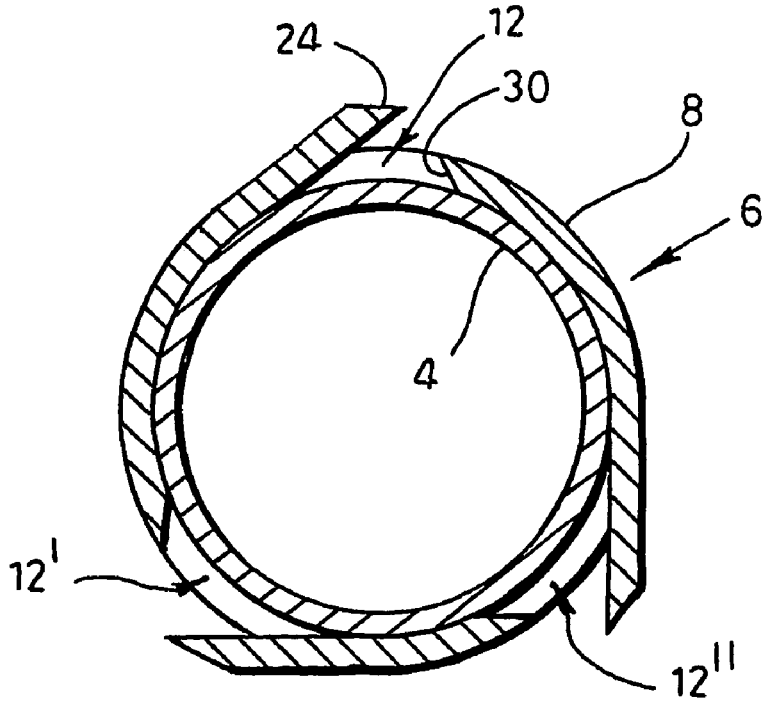
FIG. 4 schematically shows view 4—4 of FIG. 3.

Reference is further made to FIGS. 3 and 4 showing the casing 4 and stabiliser 6 after radial expansion of the casing 4 and sleeve 8. The inclined end surfaces 24, 26, 28 of the arms 19, 20, 21 are no longer locked behind the inclined end surface 30 of the remaining part of the sleeve 8, and as a result the arms 19, 20, 21 extend in their respective radially extended positions.

During normal operation the casing 4 is provided with the stabiliser 4 whereby the sleeve 8 is arranged around the casing 4 and the arms 19, 20, 21 are in their retracted positions. Subsequently the casing is lowered into the wellbore and radially expanded by, for example, pulling or pushing an expander through the casing 4. Cement slurry is pumped into the annular space between the wellbore wall and the casing 4 before or after expansion of the casing 4.

As the casing 4 radially expands, the sleeve 8 is also radially expanded. The slots 10 of the sleeve 8 thereby open up so that the force required to expand the sleeve is relatively low. The sleeve 8 stretches in circumferential direction as a result of its radial expansion, and thereby the inclined end surfaces 24, 26, 28 of the respective arms 19, 20, 21 become unlocked from the inclined end surface 30 of the remaining part of the casing 4. Each arm 19, 20, 21 springs radially outward against the wellbore wall upon unlocking of its inclined end surface 24, 26, 28 from end surface 30 due to release of the elastic deformation energy contained in the arm when the arm is radially restrained. The radial position of the arms 19, 20, 21 after unlocking is shown in FIG. 3.

The arms 19, 20, 21 are dimensioned such that the tips of the arms, after unlocking of the arms, become biased against the wellbore wall and thereby centralise and stabilise the casing 4 in the wellbore.

Instead of the sleeve being provided with longitudinal slots, the sleeve can be provided with a configuration of holes.

Furthermore, instead of cementing the casing in the wellbore, one or a number of alternative annular sealing means can be applied in the annular space between the casing and the wellbore wall.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. A stabiliser for a radially expandable tubular element extending in a wellbore drilled into an earth formation, the stabiliser comprising a radially expandable tubular member, and at least one stabiliser arm connected to the tubular member, each arm being movable from a radially retracted position to a radially extended position by the action of a spring force, the stabiliser further comprising locking means arranged to lock the arm in the retracted position when the tubular element is in the unexpanded form and to unlock the arm upon radial expansion of the tubular member so as to allow the arm to move to the extended position thereof.

2. The stabiliser of claim 1, wherein the arm is integrally connected to the tubular member and wherein the spring force stems from elastic deformation of the arm relative to the member element when the arm is in the retracted position thereof.

3. The stabiliser of claim 2, wherein the arm is defined by a cut-out portion of the tubular member.

4. The stabiliser of claim 3, wherein the arm, when in the retracted position thereof, extends in substantially circumferential direction of the tubular member.

5. The stabiliser of claim 2, wherein the locking means comprises a circumferential end surface of the arm, said end surface extending inclined relative to the circumferential direction of the tubular member.

6. The stabiliser of claim 5, wherein the locking means further comprises a circumferential end surface of the tubular member, which end surface is inclined relative to the circumferential direction of the tubular member, the respective end surfaces of the arm and the tubular member having complementary inclinations.

7. The stabiliser of claim 1, comprising a plurality of said arms including at least two said arms located at substantially the same circumferential position and at selected mutual axial spacing.

8. The stabiliser of claim 1, comprising a plurality of said arms including at least three arms at selected mutual circumferential spacing.

9. The stabiliser of claim 1, wherein the tubular element is a casing extending into the wellbore.

10. The stabiliser of claim 1 wherein the radially expandable tubular member is selected from a section of the tubular element and a sleeve surrounding the tubular element.

11. The stabiliser of claim 10, wherein the sleeve is an expandable slotted tubular member.

* * * * *